US009500024B2

(12) United States Patent
Metz et al.

(10) Patent No.: US 9,500,024 B2
(45) Date of Patent: Nov. 22, 2016

(54) FLEXIBLE OVERHEAD DOOR ASSEMBLY

(71) Applicant: DL Manufacturing, North Syracuse, NY (US)

(72) Inventors: Donald L. Metz, Kirkville, NY (US); David M. Martini, Liverpool, NY (US); Kristian P. Garrow, Cortland, NY (US); Kyle J. Berean, Canastota, NY (US)

(73) Assignee: DL Manufacturing, North Syracuse, NY (US)

( * ) Notice: Subject to any disclaimer, the term of this patent is extended or adjusted under 35 U.S.C. 154(b) by 0 days.

(21) Appl. No.: 14/483,799

(22) Filed: Sep. 11, 2014

(65) Prior Publication Data

US 2015/0075731 A1 Mar. 19, 2015

Related U.S. Application Data

(60) Provisional application No. 61/879,091, filed on Sep. 17, 2013, provisional application No. 61/878,034, filed on Sep. 15, 2013.

(51) Int. Cl.
*E06B 3/80* (2006.01)
*E06B 3/48* (2006.01)

(52) U.S. Cl.
CPC *E06B 3/486* (2013.01); *E06B 3/80* (2013.01)

(58) Field of Classification Search
CPC E05D 15/16; E06B 2009/1572; E06B 9/581
See application file for complete search history.

(56) References Cited

U.S. PATENT DOCUMENTS 5,054,536 A * 10/1991 Leist ..... E05D 15/242 160/229.1
5,170,832 A * 12/1992 Wagner ..... E05D 15/24 160/201
5,718,276 A * 2/1998 Rekret ..... E05D 15/242 160/201
6,112,799 A * 9/2000 Mullet ..... E05B 65/0021 160/201
6,615,898 B2 * 9/2003 Schulte ..... E06B 9/581 160/201
6,631,749 B1 * 10/2003 Zabala ..... E06B 9/581 160/133
6,672,362 B1 * 1/2004 Mullet ..... E05D 15/165 16/225
7,040,373 B2 * 5/2006 Snyder ..... E06B 3/7005 160/113
7,861,763 B2 * 1/2011 Leist ..... E05D 15/16 160/236
7,874,342 B2 * 1/2011 Mullet ..... E05D 15/165 160/201
2007/0044927 A1 * 3/2007 Mullet ..... E05D 15/165 160/201
2007/0062650 A1 * 3/2007 Rejc ..... E06B 9/08 160/133

* cited by examiner

*Primary Examiner* — Katherine Mitchell
*Assistant Examiner* — Scott Denion
(74) *Attorney, Agent, or Firm* — Harris Beach PLLC

(57) ABSTRACT

An impact resistant sectional door includes a plurality of interlockingly coupled extruded thermoplastic polymer elongated panels. An elongated panel edge includes a channel and an adjacent edge of an adjacent panel includes a protrusion. The protrusion nests in the channel. Each end cap is rotatingly coupled to an adjacent end cap by a door hinge. The roller is adapted to ride in a door track and to pivot about a rolling plane of the roller. An impact load applied to one or more elongated panels causes one or more of the elongated panels to elastically deform at a spring rate in response to the impact and one or more of the protrusions to slide away from one or more of the channels. The impact resistant sectional door remains substantially undamaged. A method for protecting a sectional door from an impacting force is also described.

20 Claims, 11 Drawing Sheets

RAW DATA

| TEST POINT# | FORCE lbs | DEFLECTION IN LEFT 24in | MID-POINT 48in | RIGHT 24in | |
|---|---|---|---|---|---|
| 1 | 0 | 28.25 | 28.5 | 28.5 | |
| 2 | 50 | 28.25 | 28 | 28.5 | |
| 3 | 100 | 28.125 | 27.75 | 28 | |
| 4 | 150 | 28 | 27.5 | 27.75 | |
| 5 | 200 | 27.875 | 27.25 | 27.625 | |
| 6 | 250 | 27.75 | 27.125 | 27.5 | |
| 7 | 300 | 27.5 | 26.75 | 26.375 | |
| 8 | 350 | 27.375 | 26.25 | 26.125 | |
| 9 | 400 | 27.125 | 25.5 | 26.875 | |
| 10 | | | | | |
| 11 | | | | | |
| 12 | | | | | |

FIG.9

REDUCED DATA

| TEST POINT# | FORCE lbs | DEFLECTION IN LEFT 24in | MID-POINT 48in | RIGHT 24in | |
|---|---|---|---|---|---|
| 1 | 0 | 0 | 0 | 0 | |
| 2 | 50 | 0 | 0.5 | 0 | |
| 3 | 100 | 0.125 | 0.75 | 0.5 | |
| 4 | 150 | 0.25 | 1 | 0.75 | |
| 5 | 200 | 0.375 | 125 | 0.875 | |
| 6 | 250 | 0.5 | 1.375 | 1 | |
| 7 | 300 | 0.75 | 175 | 1.125 | |
| 8 | 350 | 0.875 | 2.25 | 1.375 | |
| 9 | 400 | 1.125 | 3 | 1.625 | |
| 10 | | | | | |
| 11 | | | | | |
| 12 | | 28.25 | 28.25 | 28.25 | |

FIG.10

FLEXIBLE OVERHEAD DOOR ASSEMBLY

CROSS-REFERENCE TO RELATED APPLICATIONS

This application claims priority to and the benefit of co-pending U.S. provisional patent application Ser. No. 61/878,034, FLEXIBLE OVERHEAD DOOR ASSEMBLY, filed Sep. 15, 2013, and co-pending U.S. provisional patent application Ser. No. 61/879,091, FLEXIBLE OVERHEAD DOOR ASSEMBLY, filed Sep. 17, 2013, both of which applications are incorporated herein by reference in their entirety.

FIELD OF THE APPLICATION

The application relates to an overhead door assembly and particularly to a sectional door having elongated panels.

BACKGROUND

Overhead door assemblies, such as those generally used in loading docks, garages, warehouses, or other enclosed structures, typically include a sectional door assembly that is guided by a vertical track installed on either side of the doorway. Follower elements, such as rollers, are typically affixed to the door assembly and ride within the track as the door is raised and lowered. The door may be raised and stored in a generally vertical orientation, such as found in vertical lift and high lift installations, or the door may travel to a horizontal overhead position, such as found in a standard lift installation. Regardless of configuration, the doors can be manually operated up and down, or motor-driven. To ease the operation of the door, a torsion spring is often used to offset the weight of the door assembly.

SUMMARY

According to one aspect, an impact resistant sectional door includes a plurality of interlockingly coupled extruded thermoplastic polymer elongated panels stacked adjacent to one another. An elongated panel edge includes a channel and an adjacent edge of an adjacent panel includes a protrusion. The protrusion nests in the channel. Each end of each elongated panel is supported by an end cap. The impact resistant sectional door also includes a plurality of door hinges. Each end cap is rotatingly coupled to an adjacent end cap by the door hinge having a shaft with a roller slidingly mounted in a pivot between adjacent end caps. The roller is adapted to ride in a door track and to pivot about a rolling plane of the roller. An impact load applied to one or more elongated panels causes one or more of the elongated panels to elastically deform at a spring rate in response to the impact and one or more of the protrusions to slide away from one or more of the channels, while at least one shaft slides in at least one pivot of the plurality of door hinges and at least one roller pivots while remaining in the door track. The impact resistant sectional door remains substantially undamaged.

In one embodiment, two or more elongated panels share a common pair of end caps.

In another embodiment, the elongated panel is about 96 inches long and the impact load causes a deflection at or near a mid-span of about 4 inches.

In yet another embodiment, the elongated panel is about 18 feet long and the impact load causes a deflection at or near a mid-span of about 4 feet.

In yet another embodiment, the protrusion includes a trapezoidal shape and the channel includes a similar trapezoidal shape.

In yet another embodiment, a ledge of a first elongated edge of at least one of the elongated panels is separated from an adjacent ledge of an adjacent elongated panel second elongated edge by a gap $V_{GAP2}$, and a peak of the protrusion is separated from a trough of the channel by a gap $V_{GAP1}$ and wherein $V_{GAP2}$ is less than $V_{GAP1}$.

In yet another embodiment, at least one elongated edge and an adjacent elongated edge of at least a portion of the elongated panels includes a relief cut near at least one face side of the elongated panel.

In yet another embodiment, at least a portion of adjacent elongated panels both include the relief cut at or near at least one face of the elongated panels and the relief cuts form an angle of about 120 degrees therebetween.

In yet another embodiment, the end caps include U channels.

In yet another embodiment, the thermoplastic includes PVC.

In yet another embodiment, the thermoplastic comprises a flexible material.

In yet another embodiment, the impact resistant sectional door remains substantially undamaged as defined to about plus or minus 20% by the equation: $\text{Deflection} \cong (8^{-6} \times fd^2) + (0.0034 \times fd) + 0.19$, where the Deflection is in inches and fd is the force in pounds applied to the door at about a midpoint of the door.

In yet another embodiment, the impact resistant sectional door remains substantially undamaged as defined to about plus or minus 20% by the equation: $\text{Deflection} \cong (0.005 \times fd) - 0.05$, where the Deflection is in inches and fd is the force in pounds applied to the door at about a midpoint of the door.

In yet another embodiment, each of the elongated panels includes hollow cavities and further includes insulation disposed within and one or more of the hollow cavities defined by one or more internal support ribs adapted to substantially maintain a shape of the elongated panel during an expanding insulating foam cure process.

In yet another embodiment, at least one of the elongated panels includes three internal support ribs spanning from a front face of the elongated panel to a rear face of the elongated panel, at least one of the ribs disposed at about a center of the elongated panel.

In yet another embodiment, the impact resistant sectional door further includes an additional hinge between one or more adjacent groups disposed at about mid-span of the elongated panels.

In yet another embodiment, the impact resistant sectional door further includes at least two extruded thermoplastic polymer elongated panels stacked adjacent to one another, the elongated panel edge includes a tube and the adjacent edge of the adjacent panel includes a knob, the knob rotatingly nesting in the tube to form a knob-tube joint, the end caps of the at least two extruded thermoplastic polymer elongated panels further includes a break-away brush coupling to the door track, wherein following a deflecting impact load applied to the elongated panels having the knob-tube joint, the at least two extruded thermoplastic polymer elongated panels push away from the door track while rotating about the knob-tube joint.

According to another aspect, a flexing impact resistant sectional door includes a plurality of interlockingly coupled extruded thermoplastic polymer elongated panels stacked adjacent to one another. An elongated panel edge includes a channel and an adjacent edge of an adjacent panel includes a protrusion. The protrusion nests in the channel. Each end of each elongated panel is supported by an end cap. The flexing impact resistant sectional door also includes a plurality of door hinges. Each end cap is rotatingly coupled to an adjacent end cap by the door hinge having a shaft with a roller slidingly mounted in a pivot between adjacent end caps, the roller adapted to ride in a door track and to pivot about a rolling plane of the roller. An impact load applied to one or more elongated panels causes one or more of the elongated panels to elastically deform at a spring rate in response to the impact and one or more of the protrusions to slide away from one or more of the channels. At least one shaft slides in at least one pivot of the plurality of door hinges and at least one roller pivots while remaining in the door track. In response to the impact load, one or more elongated panels deflect and following removal of the impact load, the flexing impact resistant sectional door assumes an original unflexed intact state.

According to yet another aspect, a flexing impact resistant sectional door includes a plurality of interlockingly coupled extruded thermoplastic polymer elongated panels stacked adjacent to one another. An elongated panel edge includes a channel and an adjacent edge of an adjacent panel includes a protrusion. The protrusion nests in the channel. Each end of each elongated panel is supported by an end cap. The flexing impact resistant sectional door also includes a plurality of door hinges. Each end cap is rotatingly coupled to an adjacent end cap by the door hinge having a shaft with a roller slidingly mounted in a pivot between adjacent end caps. The roller is adapted to ride in a door track and to pivot about a rolling plane of the roller. An impact load applied to one or more elongated panels causes one or more of the elongated panels to elastically deform at a spring rate in response to the impact and one or more of the protrusions to slide away from one or more of the channels, while at least one shaft slides in at least one pivot of the plurality of door hinges and at least one roller pivots while remaining in the door track. In response to the impact load, one or more elongated panels deflect and following removal of the impact load, the sectional door remains in a partially deflected state until pushed back into an original unflexed intact state.

According to yet another aspect, a method for protecting a sectional door from an impacting force includes: providing the sectional door which includes a plurality of extruded thermoplastic polymer elongated panels nestingly coupled to each other by interlocking arrangement between adjacent elongated panels of a protruding cam on an edge of the elongated panel and a recessed cam channel on an edge of another adjacent elongated panel; displacing the sectional door by the impacting force to a face of one or more elongated panels of the sectional door; causing the protruding cam to rise up a surface of the recessed cam channel; removing the impacting force; and restoring the sectional door to an original undamaged state as the protruding cam falls back to an original relationship with respect to the surface of the recessed cam channel.

In one embodiment, the step of causing the protruding cam to rise up includes causing the protruding cam to rise up the surface of the recessed cam channel and to exit the channel and the step of restoring the sectional door to the original undamaged state further includes pushing one or more elongated channels causing the protruding cam to fall back into the channel.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

FIG. 9 shows a table of data recorded during testing of the exemplary flexible overhead door assembly;

FIG. 10 shows a table of reduced data of FIG. 9;

DETAILED DESCRIPTION

Figure 1:
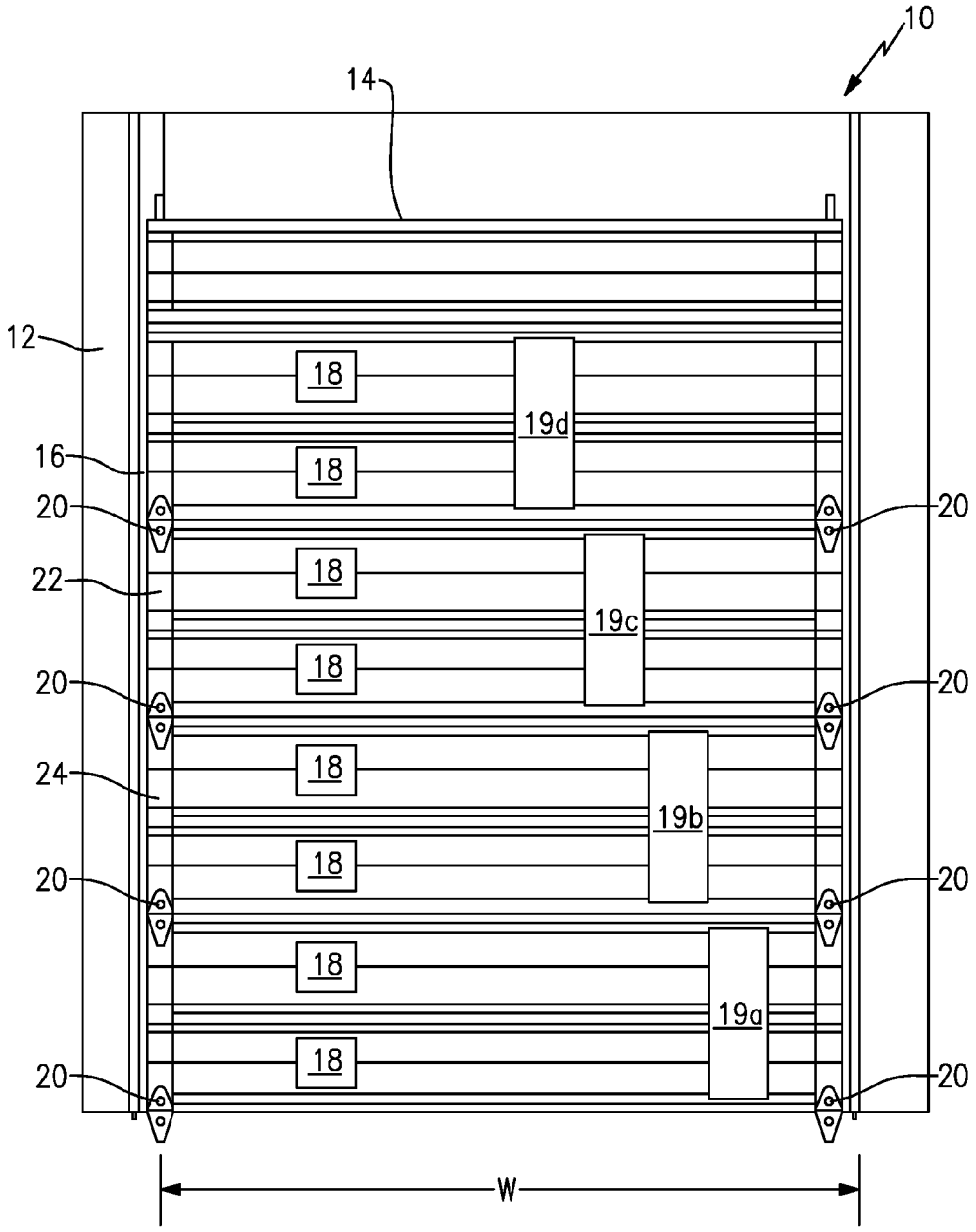
FIG. 1 depicts an inside plan view of an exemplary overhead door assembly positioned within a loading dock wall.

A typical sectional door assembly has a number of elongated panels extending transversely across the width of the door opening. The panels are arranged vertically atop one another and the abutting horizontal edges are pivotally connected by hinges to permit relative rotation between the panels. When the door opens in a standard lift installation, the hinges allow the panels to curve around onto horizontal sections of the guide track. In industrial applications, the panels are typically fabricated from heavy gauge roll formed steel for durability.

One problem with sectional door assemblies, especially in warehouse or loading dock environments, is that they are often hit by forklifts, trailers, loaded pallet jacks, and even trucks. Consequently, the door assembly may sustain damage ranging from moderate to severe. The sectional panels may be permanently deformed, the door assembly may extricate from the track assembly, or the track assembly may buckle to the point of being inoperative. The impact damage may involve expensive repairs, temporary loss of the security and environmental protection provided by the door, and in some cases may require repair of the vehicle that hit the overhead door.

Previous efforts have been made to contend with destructive forces accidentally imparted to sectional doors. In one example, a replacement sectional panel was devised to take the place of the damaged panel. The replacement sectional panel member consisted of several interlocked panel members formed of various widths. The panel members could be assembled in different combinations to create a door panel of a desired total width. In other efforts, various means were used to allow a door to pop out of its tracks to avoid damage Prior attempts at making an overhead door assembly more tolerant of impact loads generally fall into a broad category termed "knock out" configurations. In one class, the track follower or roller element that is fixed to a door panel is designed to disengage or pop out from the guide track, thereby reducing to zero the resultant forces imparted to the track and/or building wall. In one particular example, the track follower comprises stiff nylon brush bristles secured to the vertical edges of each panel. The bristles, which are positioned horizontally along the vertical edge of each panel, span the entire vertical length of the door assembly and ride inside the guide track. The bristles provide much lower resistance in case of an impact, and safely pop out of the track at smaller impact loads. In another class, the panel may disengage from the roller element. A release mechanism springs the panel free from the track, allowing it to safely pivot out of the way.

Once disengaged, various methods have been devised to reengage the panel or roller elements. Some methods are complex, and some are claimed to be simple, but all require manual effort and involve interruption of work time. Furthermore, once the panels are disengaged from the track there no longer exists an environmental seal around the door, which may be critical in refrigerated operations. Thus, although prior 'knock-out' methods can be useful and may be advantageous for certain applications, they suffer drawbacks.

Most overhead door assemblies fall into two general categories. A first category encompasses unmodified doors that are rigid and unyielding, and therefore highly susceptible to impact damage. A second category encompasses so-called knock-out designs that pop out at pre-determined impact loads, but require reinstallation to the track.

It was realized that there is a need for a more flexible door assembly that can yield or deflect under impact load but, like a spring, return to its original position without having to be reinstalled.

One solution is a new flexible overhead door assembly includes elongated panels which have a characteristic spring rate. In some embodiments, the spring rate permits the door assembly to deflect over three inches under an impact load of approximately 400 pounds, and then return to its original position when the impact load is removed. It was further realized that a flexible overhead door assembly having elongated panels that can absorb a large impact load without popping out of the tracks and without damaging the track follower elements can solve the problem of overhead door assembly impact.

The spring rate can be achieved, for example, by arranging the door panels into flexible segments. In one exemplary embodiment, the elongated door panels are interlocked and paired. The interlock along the longitudinal or lateral seam between a pair of panels can be configured to allow relative movement such that when impacted, one panel follows a constrained path. When the impact load is removed, the constraining forces cause the panel to move in reverse direction and return to its normal position.

FIG. 1 depicts an inside plan view of an exemplary embodiment of an overhead door assembly 10 having elongated panels positioned within a loading dock wall 12. The view is illustrated from within a loading dock bay looking towards the outside. The overhead door assembly 10 includes a sectional door assembly 14 that is guided by a vertical guide track assembly 16 installed on either side of the wall 12. While the illustrated exemplary guide track assembly 16 is a tiltback arrangement, the elongated panel approach as described herein will work with any track configuration, such as high lift or standard lift.

The sectional door assembly 14 has a number of elongated panels 18 extending transversely across the width of the door opening. In some embodiments, in order to provide the required flexibility and environmental endurance, each panel 18 may be formed of ultraviolet-inhibited, weather resistant polyvinylchloride (PVC). The panels may be arranged vertically atop one another with an interlocking feature. Furthermore, the panels 18 may be grouped to provide a characteristic spring rate for the sectional door assembly 14. In some embodiments, the panels 18 are grouped in pairs 19*a*, 19*b*, 19*c*, and 19*d*. Note that in the exemplary embodiment of FIG. 1, the uppermost panel 18 in the sectional door assembly 14 has no pair. However, since it is unlikely to encounter an impact load, it will not detrimentally affect the characteristic spring rate. Each panel group 19 may be pivotally connected by hinges 20 to permit relative rotation between the panel groups. Panels can be grouped together in any suitable number of panels (i.e. one to N panels). Also, there could be different numbers of panels in groups of panels within the same sectional door.

An end cap 22 may be provided to support the flexible panels 18 on each side. In the exemplary embodiment of FIG. 1, the end cap 22 is a U-shaped vertical channel that captures and surrounds the end of one or more panels 18. The end caps can be formed from any suitable material. For example, the end caps can be made from a metal, such as by bending a metal stock. In one example, the end cap 22 of FIG. 1 may be formed of galvanized steel. The end cap 22 may be secured to the panels 18 with fasteners 24, such as screws or the like, and the fasteners 24 may also secure the hinges 20 to the end cap.

Figure 3:
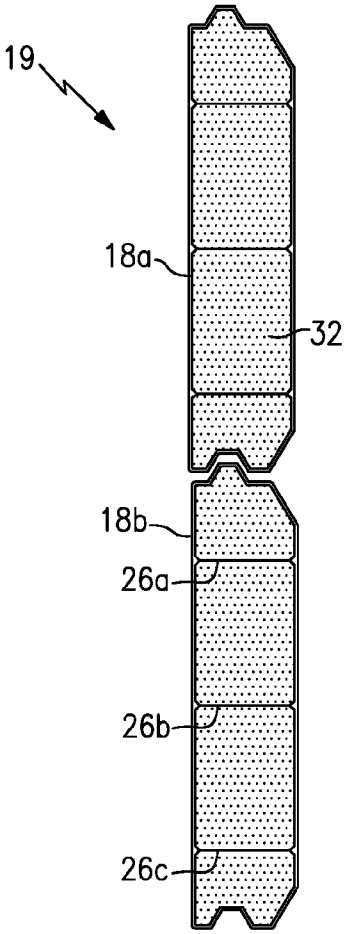
FIG. 3 depicts an end view of the panel shown in FIG. 2.
Figure 2:
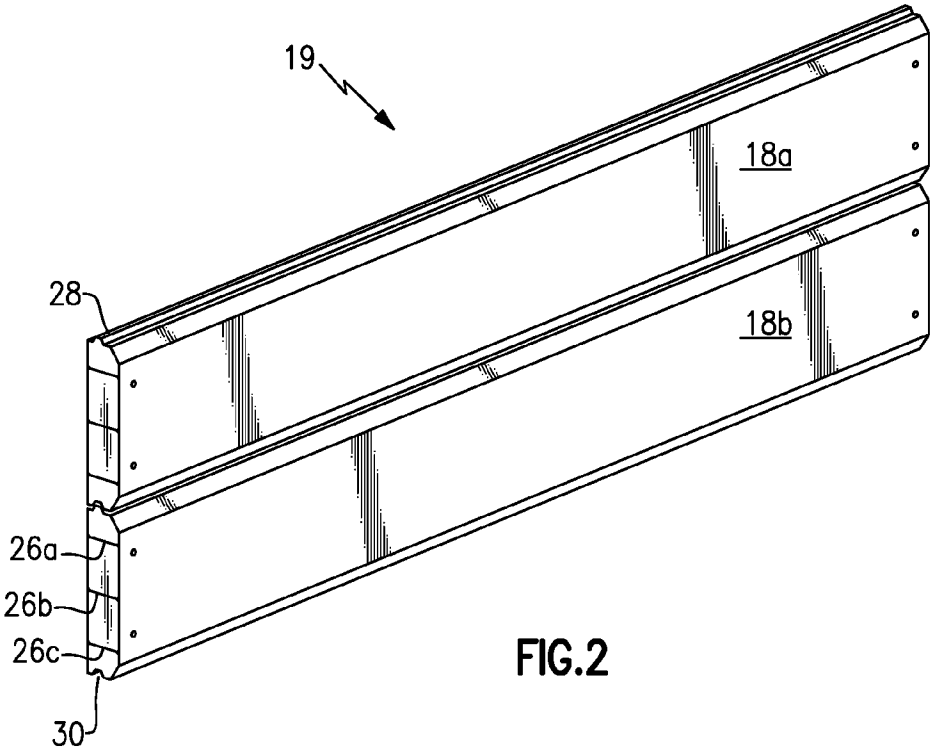
FIG. 2 depicts a perspective view of an exemplary elongated panel.

FIG. 2 depicts a perspective view of an exemplary panel group 19, and FIG. 3 depicts an end view of the same panel group. Each panel 18 in the group may be formed of a hollow, lightweight PVC member having integral reinforcement ribs 26*a*, 26*b*, and 26*c* to maintain the shape of each panel. Such panels can be made by extruding a thermoplastic though a panel mold. To facilitate nesting the panels 18 vertically atop one another, each panel 18 may be provided with a protrusion such as an elongated interlock element 28 on the upper edge and a complementary groove or channel, such as, for example, channel 30 along the bottom edge of the panel. Due to the complementary shape of the interlock element 28 and the bottom channel 30, adjacent panels can be connected relative to each other only by longitudinal insertion of the interlock element 28 into the channel 30. In one embodiment, the panels 18 may include insulation material 32 to provide a thermal barrier with external environments. The insulation material 32 is particularly useful in cold storage applications. In one example, the insulation material 32 is expanded polystyrene (EPS) closed cell foam, and the insulated panel 18 has an R-value of R-22.

Typically elongated panels are similar to each other, such as when extruded from a common mold. However, there can be embodiments where elongated panels are different from an adjacent elongated panel. For example, there could be an elongated panel with a protrusion running along both edges next to an adjacent elongated panel having corresponding channels running along both edges.

Also, the panels at the two ends of the door (e.g. the top most and bottom most elongated panels) might or might not have channels or protrusions, because those two elongated panels typically do not engage the edge of an adjacent panel.

Figure 4:
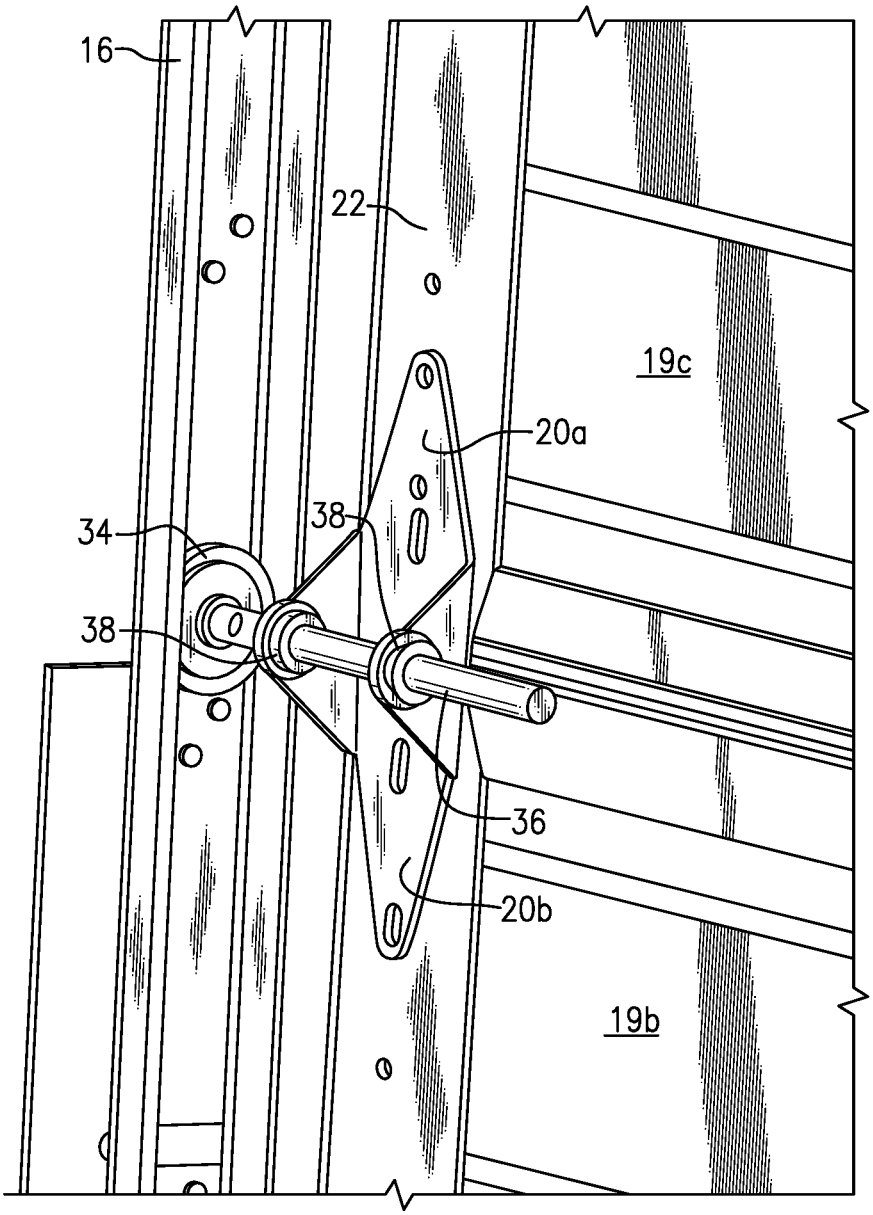
FIG. 4 depicts a perspective side view of one exemplary embodiment of the track follower element shown in FIG. 1.

FIG. 4 depicts a perspective side view of one exemplary embodiment of a track follower element 34. The view is illustrated from inside the loading dock area, looking towards the wall 12. The hinge 20 is fastened to the end cap 22 and panel 18, as noted above. The hinge 20 includes an upper half 20*a* and a lower half 20*b* rotatably coupled to a shaft 36 via bushings 38. The track follower element 34 at the end of the shaft 36 rides in the U-shaped vertical channel of the guide track assembly 16. Unlike prior art systems that were designed to pop out of the track when the door sustained an impact, the track follower element 34 remains intact in the track during and following an impact event.

Figure 5:
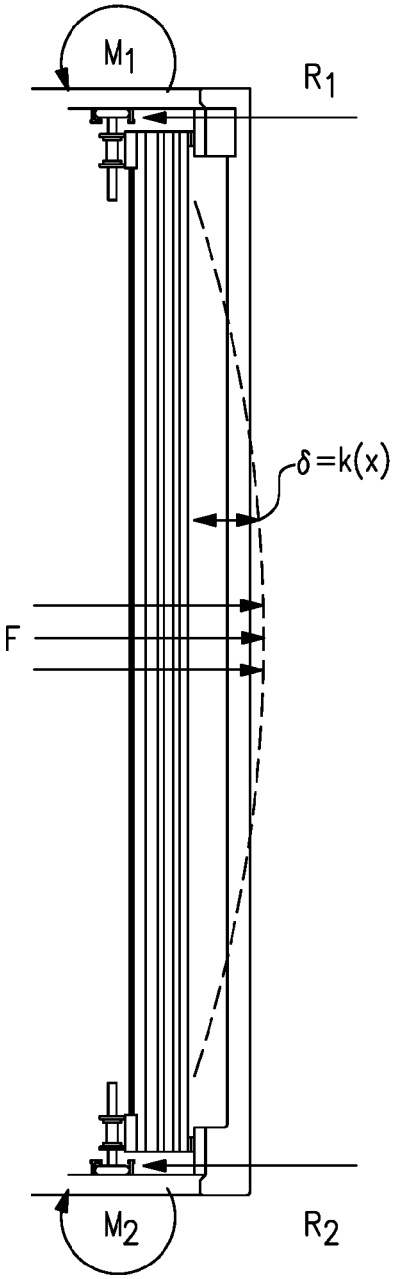
FIG. 5 illustrates a top view of the overhead door assembly shown in FIG. 1, and a simplified free body diagram.
Figure 5A:
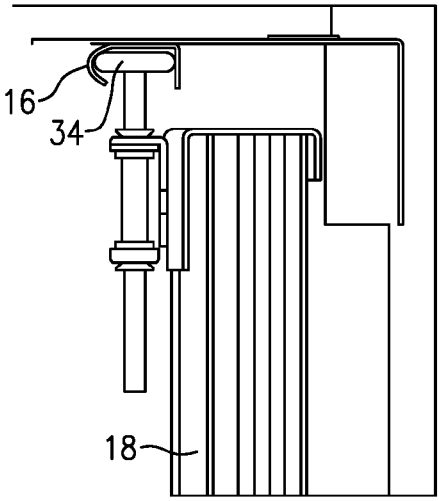
FIG. 5A shows a drawing illustrating one exemplary hinge, shaft, and roller in one side of a door track of FIG. 5.
Figure 5B:
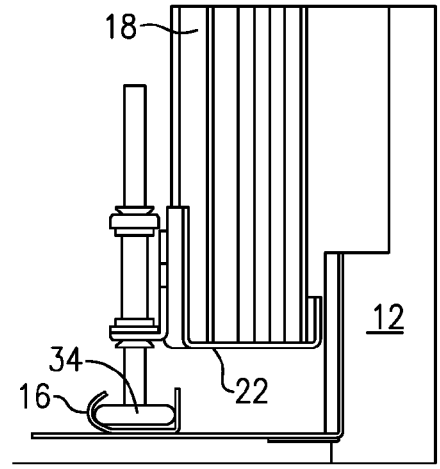
FIG. 5B shows a drawing illustrating one exemplary hinge, shaft, and roller in another side of the door track of FIG. 5.

FIG. 5 illustrates a top view of the overhead door assembly 10 and a simplified free body diagram depicting the external loads and reactionary forces acting on the system. FIGS. 5A and 5B are enlarged views illustrating the track follower element 34 in the guide track assembly 16. Under normal operating conditions, the sectional door assembly 14 is pulled open or closed in the vertical direction, so there are negligible reaction forces on the track follower element 34. However, under a transverse impact load, the track follower element 34 is the only point in the system where impact loads are transferred to the wall 12 of the loading dock. Because the panels 18 can be very wide (e.g., 80 inches), a transverse impact load in the center of the door can result in a very large moment (M1, M2) generated about track follower element 34. The dashed line represents the deflection of the sectional door assembly 14 under a transverse impact load. A stiff system (e.g., metal door panels) has very little deflection δ and therefore very high reaction forces. A knock-out system also has very little deflection, since the door panels or track followers break free under small to moderate loads.

Figure 6:
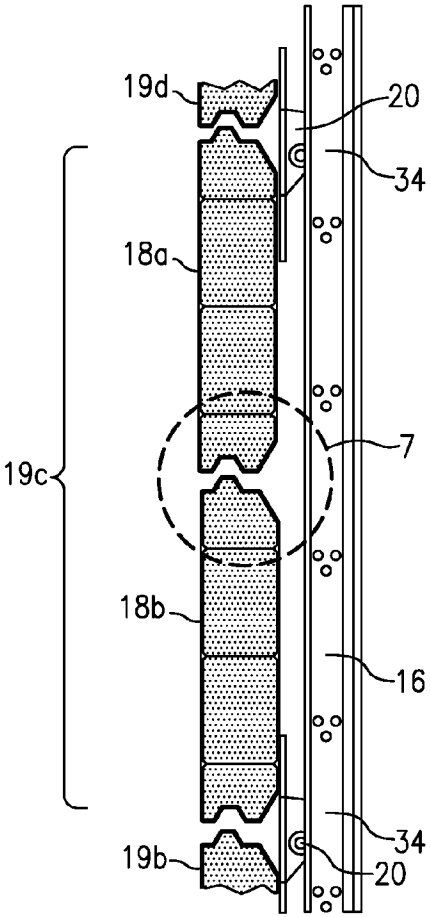
FIG. 6 depicts a side view of the panels shown in FIG. 1.

FIG. 6 depicts a side cross-sectional view of one exemplary panel group 19*c* as shown in FIG. 1, comprising upper panel 18*a* and lower panel 18*b*. End cap 22 has been removed for clarity.

Figure 7:
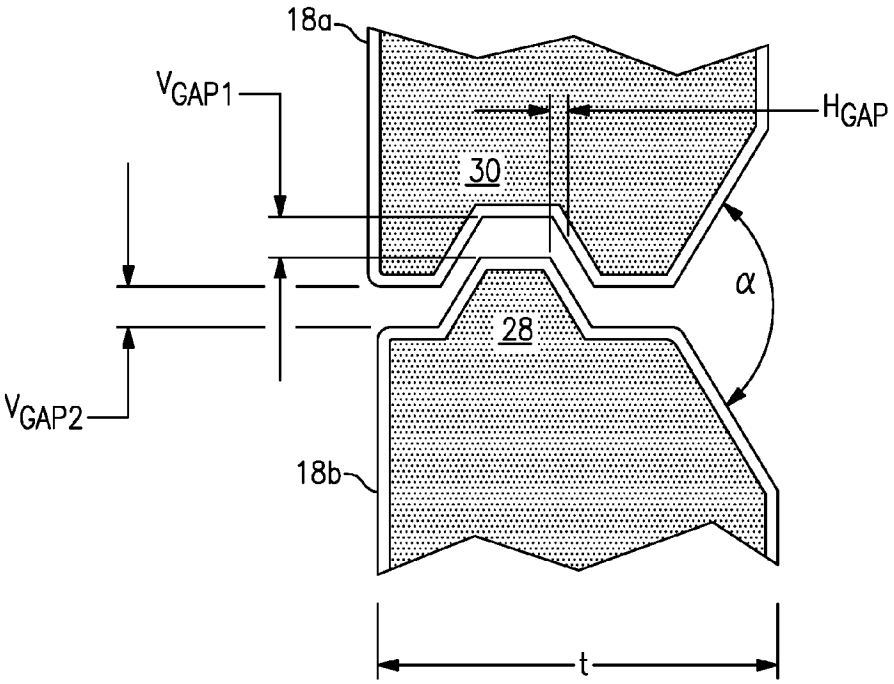
FIG. 7 shows a drawing illustrating a more detailed view of the exemplary trapezoidal protrusion and matching channel of the panels of FIG. 6.

FIG. 7 is an enlarged view of the interlock between panels 18*a* and 18*b*. In the illustrated embodiment, the interlock comprises an interlock element 28 on lower panel 18*b* and a corresponding channel 30 on upper panel 18*a*. The relative spacing between panels 18*a* and 18*b* defines a first vertical gap ($V_{GAP1}$) between the interlock element 28 and the channel 30; a second vertical gap ($V_{GAP2}$) between horizontal facing surfaces of panels 18*a* and 18*b*; and a horizontal gap ($H_{GAP}$) between the interlock element 28 and the channel 30. In one exemplary embodiment, $V_{GAP2}$ is less than $V_{GAP1}$, to allow adequate rolling movement between the upper and lower panels.

As noted earlier, the panels 18 may be secured at their ends by a rigid end cap 22. Combinations of materials, as described herein, including, for example, size, gap spacing, a characteristic spring rate allow the door assembly 14 to flex and return to its original shape.

Example: Elongated panels 18 were formed of PVC having a width W=96 inches, a height H=12 inches, and a thickness t=3.0 inches. Suitable vertical and horizontal gaps were found to be in a range between 0.10 and 0.30 inches, which provided some lateral movement prior to contact. Additionally, a relief cut defined by α=120 degrees allowed for further deflection and rolling.

Figures 8A, 8B, 8C:
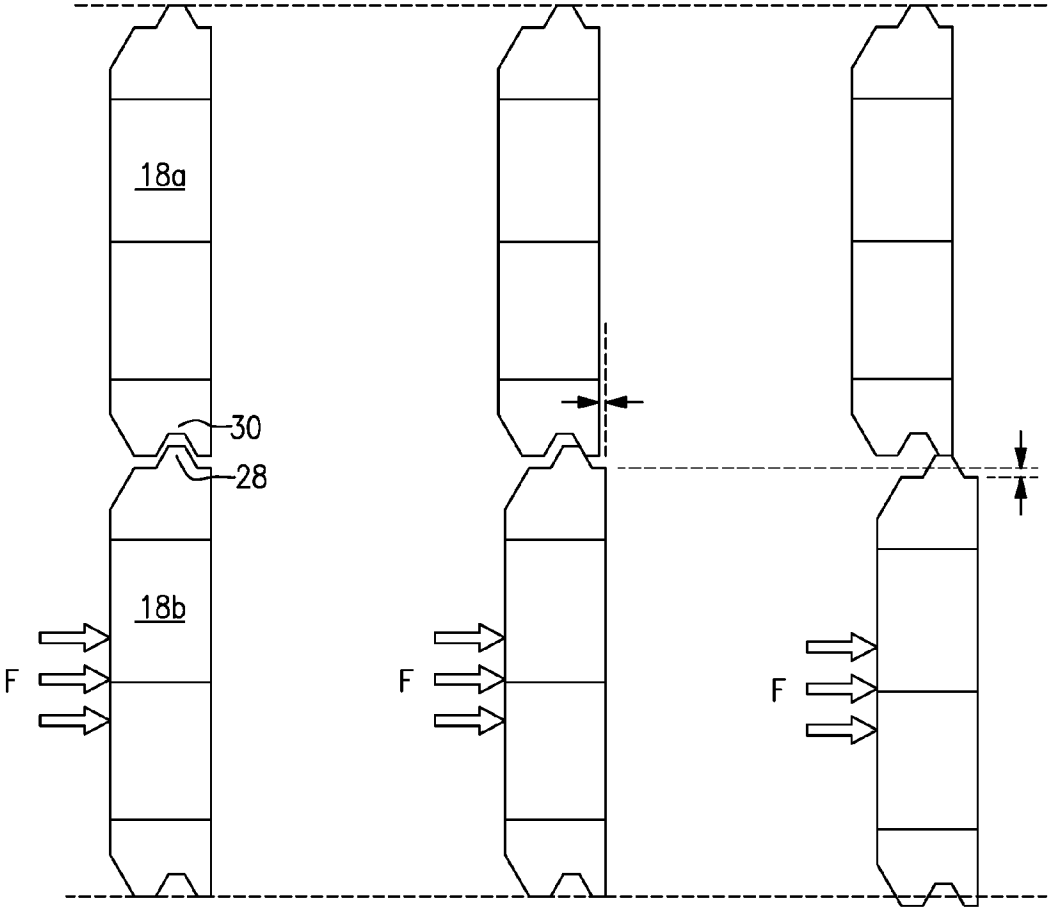
FIG. 8A depicts a side view of the panels shown in FIG. 1 at impact.
FIG. 8B shows drawing illustrating a side view of the panels shown in FIG. 1 where the impact causes a protrusion to move away from an adjacent channel.
FIG. 8C shows drawing illustrating a side view of the panels shown in FIG. 1 where the impact causes a protrusion to move out of an adjacent channel.

FIGS. 8A-8C depict the relative movement between panels 18*a* and 18*b* during an impact load F. Here the exemplary protrusions are trapezoidal cams and the adjacent channels are correspondingly shaped. FIG. 8A depicts the interlock spacing at the time of impact. FIG. 8B depicts the interlock spacing moments later, when the horizontal gap ($H_{GAP}$) is closed. Thereafter, the interlock element 28 is forced to follow a downward path along the slope of the channel 30, which may also cause the panels to roll out and separate. FIG. 8C illustrates the motion of the separated panels, where friction between the contacting surfaces prevents the panels from separating completely. The constrained motion of the interlock and subsequent panel deflection causes a preload to build in the panels. Thus, when the impact force is removed, the preloaded condition causes the panels 18*a* and 18*b* to return to their original condition, much like a spring.

Example: A panel and interlock arrangement sustains a 400 pound impact force, deflects approximately three inches, and returns to its original shape. FIGS. 9-11 present data recorded during testing of one exemplary implementation. Deflection measurements (δ) were taken at three points along the span of a panel at a height approximately where a fork lift would likely hit. Measurements were recorded at mid-span (48 inches) and 24 inches to either side of mid-span. Consecutively increasing impact loads were applied from 50 to 400 pounds. At no time was any structural damage noted to the sectional door assembly 14. Even at 400 pounds load and over 3 inches of deflection, the panels returned to their original position when the load was removed.

Figure 11A:
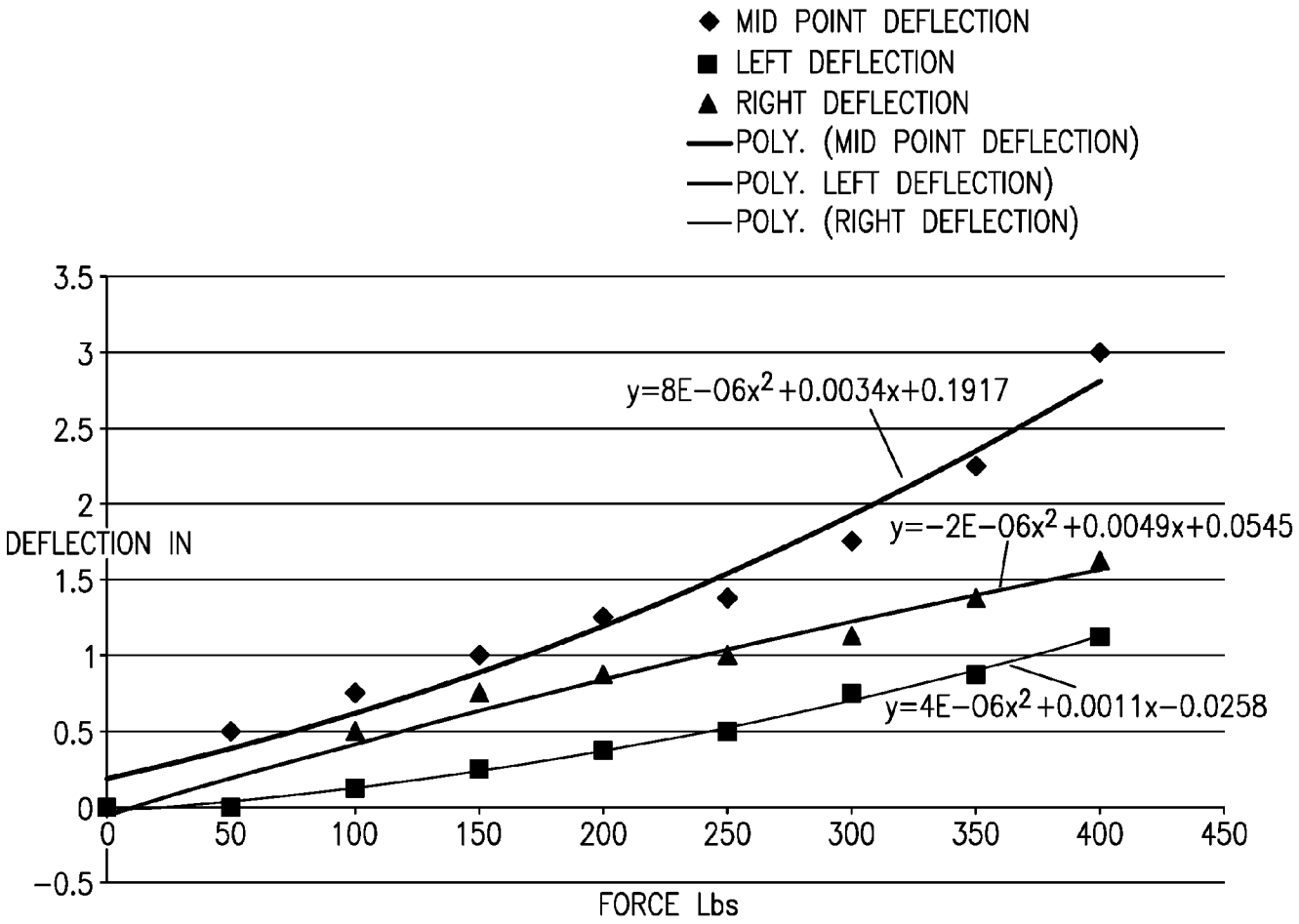
FIG. 11A shows a graph of deflection versus applied force depicting data recorded during testing of an exemplary flexible overhead door assembly.

FIG. 11A shows a graph of deflection versus door width for an exemplary flexible overhead door assembly. For the exemplary door, the amount of deflection without damage to the door was estimated within about plus or minus 20% to be about: $\text{Deflection} \cong (8\times10^{-6}\times fd^2)+(0.0034\times fd)+0.19$ where the Deflection is in inches and fd is the force in pounds applied to the door at about a midpoint of the door.

Figure 11B:
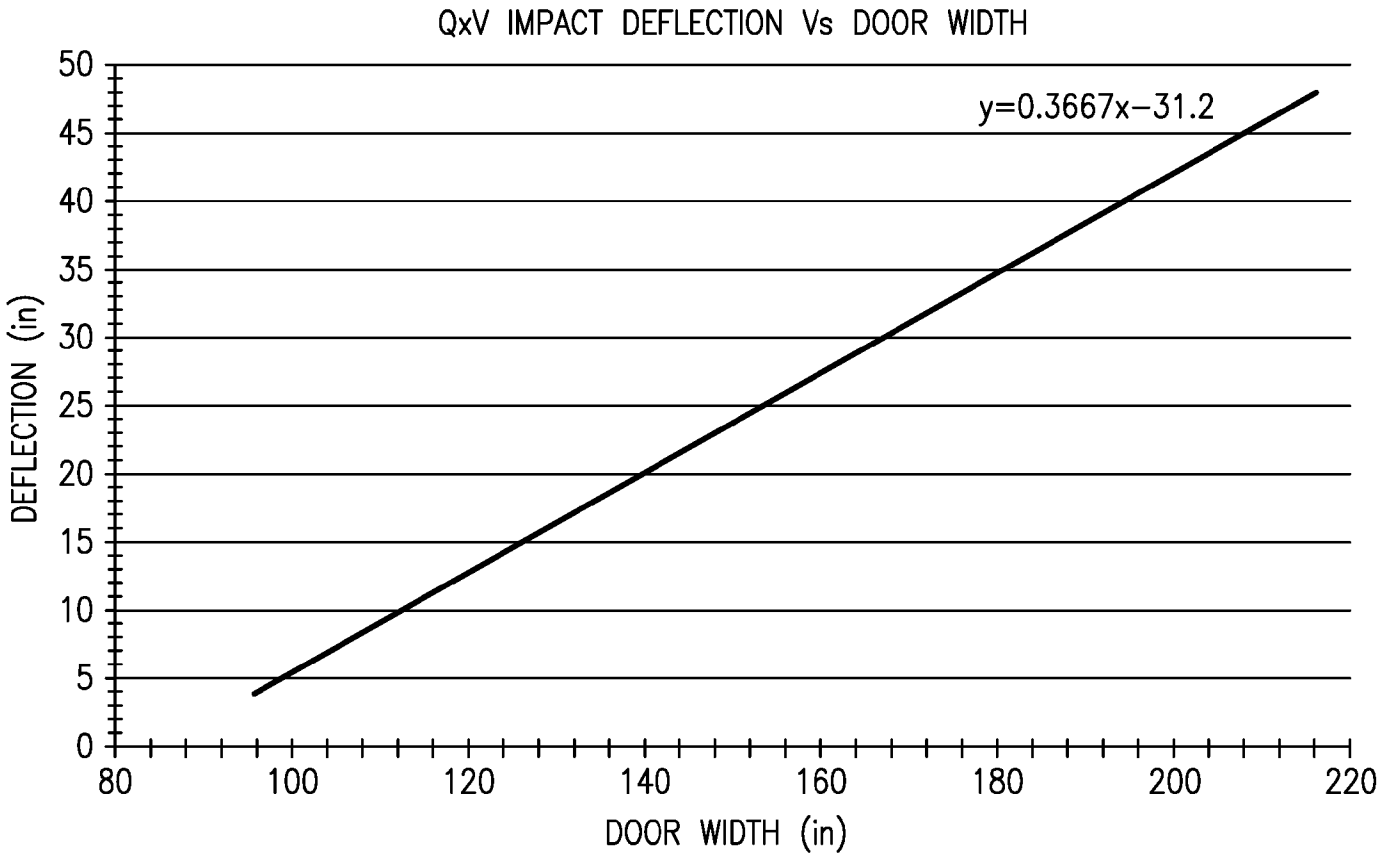
FIG. 11B shows a graph of deflection versus door width for an exemplary flexible overhead door assembly.

FIG. 11B shows a graph of deflection versus door width for an exemplary flexible overhead door assembly. For the exemplary QxV door, the amount of deflection without damage to the door was estimated within about plus or minus 20% to be about: $\text{Deflection} \cong (0.37\times Dw)-31$, where the Deflection is in inches and Dw is the door width in inches.

Figure 12:
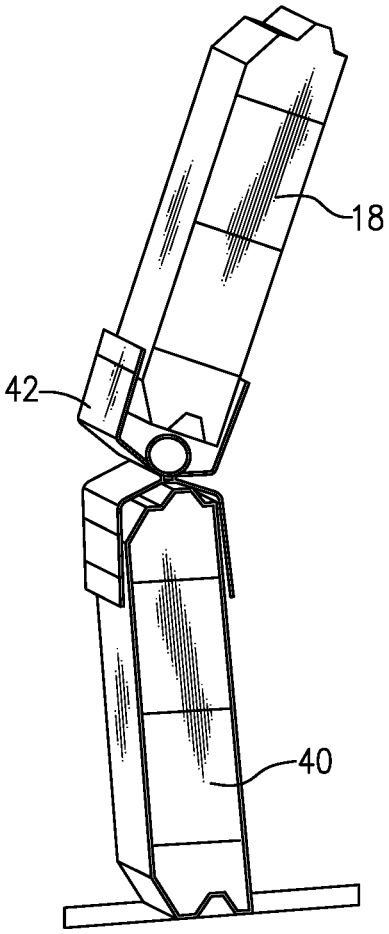
FIG. 12 depicts an exemplary edge with a tube and an adjacent uncoupled knob.
Figure 13:
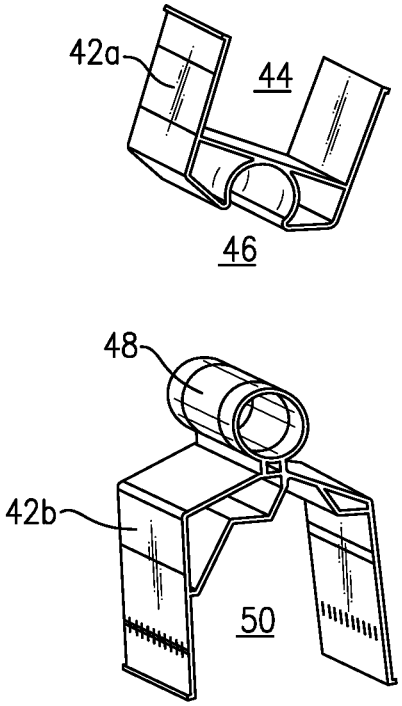
FIG. 13 shows a drawing of the edges of FIG. 12 now coupled to form a knob-tube joint.

Referring now to FIGS. 12 and 13, in another exemplary embodiment, the sectional door assembly 14 may include a knock-out panel 40. The knock-out panel 40 may be useful if the impact force exceeds the design limitation for the characteristic spring rate. The knock-out panel 40 may be joined to the standard panel 18 by a two-piece rotatable coupling 42. The upper portion of the exemplary upper coupling 42*a* is provided with a U-shaped channel 44 which is open for the reception of the lower portion of a standard panel 18. The lower portion of the exemplary upper coupling 42*a* is provided with a rounded recess 46 spanning the length. The upper portion of the lower coupling 42*b* is provided with a rounded portion 48 that is engaged lengthwise with the rounded recess 46. The lower portion of the lower coupling 42b is provided with a U-shaped channel 50 which is open for the reception of the knock-out panel 40. Due to the complementary shape of the rounded recess 46 and the rounded portion 48, the knock-out panel 40 can be rotatably connected relative to the standard panel only by longitudinal insertion of the rounded portion 48 into the rounded recess 46. If the impact force is well above the design limit (above 400 pounds, for example), the rounded portion 48 can separate from the recess 46 to limit any damage to the panel. The panels will return to their original shape and can be reassembled.

It can now be seen that an impact resistant sectional door typically includes a plurality of interlockingly coupled extruded thermoplastic polymer elongated panels stacked adjacent to one another. An elongated panel edge includes a channel and an adjacent edge of an adjacent panel includes a protrusion. The protrusion nests in the channel. Each end of each elongated panel is supported by an end cap. The impact resistant sectional door also includes a plurality of door hinges. Each end cap is rotatingly coupled to an adjacent end cap by the door hinge having a shaft with a roller slidingly mounted in a pivot between adjacent end caps. The roller is adapted to ride in a door track and to pivot about a rolling plane of the roller. An impact load applied to one or more elongated panels causes one or more of the elongated panels to elastically deform at a spring rate in response to the impact and one or more of the protrusions to slide away from one or more of the channels, while at least one shaft slides in at least one pivot of the plurality of door hinges and at least one roller pivots while remaining in the door track. The impact resistant sectional door remains substantially undamaged.

In some situations, in response to an impact load, one or more elongated panels deflect and following removal of the impact load, the flexing impact resistant sectional door assumes an original unflexed intact state, such as without any manual intervention. In other situations, in response to the impact load, one or more elongated panels deflect and following removal of the impact load, the sectional door remains in a partially deflected state until pushed back (e.g. pushed back manually by hands) into an original unflexed intact state.

Figure 14:
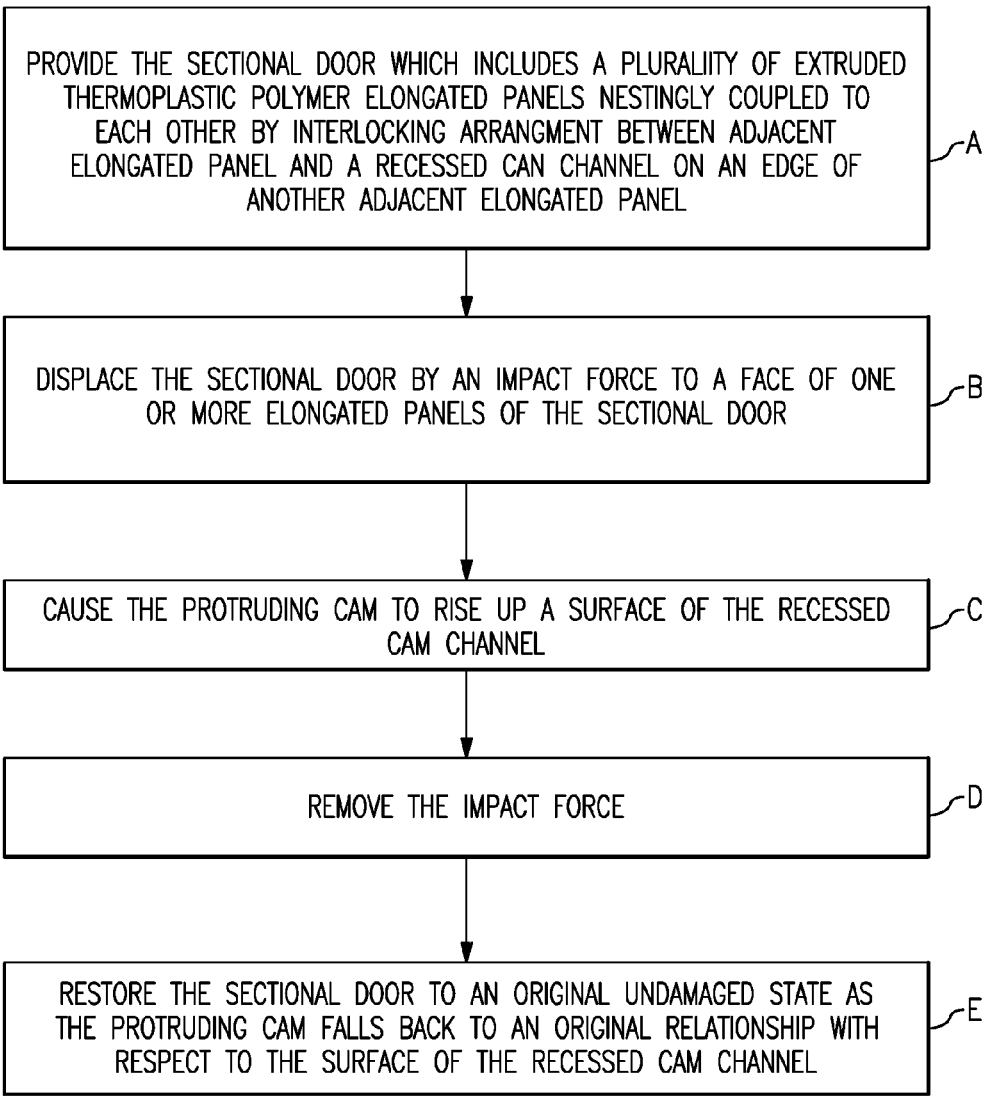
FIG. 14 shows a flow chart of a new method of non-destructive response of a flexible overhead door assembly to an impact event.

Method: FIG. 14 shows a flow chart of a new method of non-destructively operating a flexible overhead door assembly during an impact event. In one exemplary embodiment, a method for protecting a sectional door from an impacting force includes the steps of: A) provide the sectional door which includes a plurality of extruded thermoplastic polymer elongated panels nestingly coupled to each other by interlocking arrangement between adjacent elongated panels of a protruding cam on an edge of the elongated panel and a recessed cam channel on an edge of another adjacent elongated panel; B) displace the sectional door by an impact force to a face of one or more elongated panels of the sectional door; C) cause the protruding cam to rise up a surface of the recessed cam channel; D) remove the impact force; and E) restore the sectional door to an original undamaged state as the protruding cam falls back to an original relationship with respect to the surface of the recessed cam channel.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An impact resistant sectional door comprising:

at least one or more sectional door assemblies comprising:

a first half assembly and a second half assembly, each of said first half assembly and said second half assembly having at least two flexible elongated panels mechanically coupled together by a common end cap at each end of each flexible elongated panel, a first half assembly left end cap to couple each left end of each first half assembly flexible elongated panel and a first half assembly right end cap to couple each right end of each first half assembly flexible elongated panel, a second half assembly left end cap to couple each left end of each second half assembly flexible elongated panel and a second half assembly right end cap to couple each right end of each second half assembly flexible elongated panel, at least one flexible elongated panel of said at least two flexible elongated panels stacked above another flexible elongated panel, each flexible elongated panel comprising:

an elongated panel upper edge comprising a cam channel formed in said elongated panel upper edge; and an elongated panel lower edge comprising a cam protrusion formed in said elongated panel lower edge, said cam protrusion of a flexible elongated panel above to nest in said cam channel of an adjacent flexible elongated panel disposed adjacent to and below said flexible elongated panel above;

a pair of door hinges comprising a left side hinge rotatingly coupling said first half assembly left end cap to said second half assembly left end cap and a right side hinge rotatingly coupling said first half assembly right end cap to said second half assembly right end cap, each door hinge having a shaft with a roller slidingly mounted in a pivot between adjacent end caps, said roller adapted to ride in a door track and to pivot about a rolling plane of said roller;

wherein an impact load applied to one or more flexible elongated panels causes one or more of said flexible elongated panels to flex in response to the impact load, and one or more of said cam protrusions to slide away from one or more of said cam channels, while at least one shaft slides in at least one pivot of said pair of door hinges and at least one roller pivots while remaining in said door track; and wherein after said impact load has been removed, said impact resistant sectional door substantially undamaged.

2. The impact resistant sectional door of claim 1, wherein said flexible elongated panel is about 96 inches long and said impact load causes a deflection at or near a mid-span of about 4 inches.

3. The impact resistant sectional door of claim 1, wherein said flexible elongated panel is about 18 feet long and said impact load causes a deflection at or near a mid-span of about 4 feet.

4. The impact resistant sectional door of claim 3, wherein a ledge of a first elongated edge of at least one of said flexible elongated panels is separated from an adjacent ledge of an adjacent elongated panel second elongated edge by a gap $V_{GAP2}$, and a peak of said cam protrusion is separated from a trough of said cam channel by a gap $V_{GAP1}$ and wherein $V_{GAP2}$ is less than $V_{GAP1}$.

5. The impact resistant sectional door of claim 1, wherein said cam protrusion comprises a trapezoidal shape and said cam channel comprises a corresponding trapezoidal shape.

6. The impact resistant sectional door of claim 1, wherein at least one elongated edge and an adjacent elongated edge of at least a portion of said flexible elongated panels comprises a relief cut near at least one face side of said flexible elongated panel.

7. The impact resistant sectional door of claim 6, wherein at least a portion of adjacent flexible elongated panels both include said relief cut at or near at least one face of said flexible elongated panels and said relief cuts form an angle of about 120 degrees therebetween.

8. The impact resistant sectional door of claim 1, wherein said end caps comprise U channels.

9. The impact resistant sectional door of claim 1, wherein said impact resistant sectional door remains substantially undamaged as defined to about plus or minus 20% by: $\text{Deflection} \cong (8\times10^{-6}\times fd^2)+(0.0034\times fd)+0.19$, where Deflection is in inches and fd is force in pounds applied to said impact resistant sectional door at about a midpoint of said impact resistant sectional door.

10. The impact resistant sectional door of claim 1, wherein said impact resistant sectional door remains substantially undamaged as defined to about plus or minus 20% by: $\text{Deflection} \cong (0.3667\times Dw)-31.2$, where Deflection is in inches and Dw is a width of said impact resistant sectional door in inches.

11. The impact resistant sectional door of claim 1, wherein each of said flexible elongated panels comprises hollow cavities and further comprises insulation disposed within and one or more of said hollow cavities defined by one or more internal support ribs adapted to substantially maintain a shape of said flexible elongated panel during an expanding insulating foam cure process.

12. The impact resistant sectional door of claim 11, wherein at least one of said flexible elongated panels comprises three internal support ribs spanning from a front face of said flexible elongated panel to a rear face of said flexible elongated panel, at least one rib of said three internal support ribs disposed at about a center of said flexible elongated panel.

13. The impact resistant sectional door of claim 1, further comprising an additional hinge between one or more adjacent groups disposed at about mid-span of said flexible elongated panels.

14. The impact resistant sectional door of claim 1, further comprising at least one or more additional extruded thermoplastic polymer elongated panels stacked adjacent to one another, an elongated panel edge comprising a tube and an adjacent edge of an adjacent panel comprising a knob, said knob rotatingly nesting in said tube to form a knob-tube joint, said end caps of said at least one or more additional extruded thermoplastic polymer elongated panels further comprising a break-away brush coupling to said door track, wherein following a deflecting impact load applied to said at least one or more additional extruded thermoplastic polymer elongated panels having said knob-tube joint, said at least one or more additional extruded thermoplastic polymer elongated panels push away from said door track while rotating about said knob-tube joint.

15. The impact resistant sectional door of claim 1, wherein said flexible elongated panel comprises an extruded thermoplastic.

16. The impact resistant sectional door of claim 15, wherein said flexible elongated panel further comprises a core comprising an insulating material.

17. The impact resistant sectional door of claim 15, wherein said thermoplastic comprises PVC.

18. The impact resistant sectional door of claim 15, wherein said thermoplastic comprises a flexible material.

19. A method for protecting the impact resistant sectional door of claim 1 from an impacting force, the method comprising:

providing said impact resistant sectional door of claim 1;

displacing said impact resistant sectional door by an impacting force to a face of one or more elongated panels of said impact resistant sectional door;

causing said cam protrusion to rise up a surface of said cam channel;

removing said impacting force; and restoring said impact resistant sectional door to an original undamaged state as said cam protrusion falls back to an original relationship with respect to said surface of said cam channel.

20. The method of claim 19, wherein said step of causing said cam protrusion to rise up comprises causing said cam protrusion to rise up said surface of said cam channel and to exit said cam channel and said step of restoring said impact resistant sectional door to said original undamaged state further comprises pushing one or more elongated channels causing said cam protrusion to fall back into said cam channel.

* * * * *